US007473113B2

(12) United States Patent
Koda

(10) Patent No.: US 7,473,113 B2
(45) Date of Patent: Jan. 6, 2009

(54) ELECTRICAL CONNECTION FOR HIGH HUMIDITY AND LOW TEMPERATURE ENVIRONMENTS

(76) Inventor: Kojiro Koda, 4-17-1, Nishigahara, Kita-ku, Tokyo (JP) 114-0024

( * ) Notice: Subject to any disclaimer, the term of this patent is extended or adjusted under 35 U.S.C. 154(b) by 0 days.

(21) Appl. No.: 11/731,155

(22) Filed: Mar. 31, 2007

(65) Prior Publication Data

US 2008/0242132 A1 Oct. 2, 2008

(51) Int. Cl.
*H01R 13/62* (2006.01)

(52) U.S. Cl. ..... 439/157; 439/160; 439/372

(58) Field of Classification Search ..... 439/587, 439/278, 271, 310, 372, 157, 160
See application file for complete search history.

(56) References Cited

U.S. PATENT DOCUMENTS 4,776,813 A * 10/1988 Wilson et al. ..... 439/587
5,340,327 A 8/1994 Koda
2003/0003786 A1* 1/2003 Bakker et al. ..... 439/157
2003/0017733 A1* 1/2003 Fujii ..... 439/157
2005/0003690 A1* 1/2005 Fukamachi ..... 439/157
2006/0178049 A1* 8/2006 Ishikawa ..... 439/587

* cited by examiner

*Primary Examiner*—Tho D Ta
*Assistant Examiner*—Travis Chambers
(74) *Attorney, Agent, or Firm*—Wagner, Anderson & Bright, LLP; Roy L Anderson

(57) ABSTRACT

A plug and socket electrical connection for environments with high humidity and low temperatures has a socket with female connections (holes with an electrical terminals), a circular recess for receiving a mating part and tabs and a plug with a male connection (electrodes), the mating part and hooks. The electrical connections are protected from moisture by a snug fit and o-rings when the socket and the plug are electrically connected and the tabs and hooks hold the socket and plug together in place. The socket and plug are disconnected by movement of a handle holding the hooks that is part of the plug and can act as a lever to help the disconnection. The handle also provides a convenient finger hold for pulling the plug away from the socket.

10 Claims, 7 Drawing Sheets

(B)

ELECTRICAL CONNECTION FOR HIGH HUMIDITY AND LOW TEMPERATURE ENVIRONMENTS

FIELD OF THE INVENTION

The present invention is in the general field of plug and socket electrical connections but, more particularly, in the specialized field of electrical connections designed for use inside of refrigerated showcases in cold and humid conditions where traditional plug and socket electrical connections do not provide suitable results.

BACKGROUND OF THE INVENTION

Plug and socket structures are well known for use as electrical wiring connectors. These structures typically have a male connector that is inserted into a female connector and plug and socket structures come in a variety of shapes, sizes and specialized components depending upon their intended use. The male connector typically has a wire harness connected to it and it is typically held in place by inserting electrodes of the male connector into holes in the female connector while the electrical connection is made between the electrodes and terminals inside of the holes.

The present invention is focused on electrical connectors of the plug and socket variety that are used in humid conditions, such as refrigerated showcases one might find in a grocery store, that are used to display chilled and/or frozen food. Because of the humidity found in such conditions, a problem arises if the electrical connector is not firmly connected or if the resultant connection is not waterproof because, once water infiltrates the connection, humidity and rust can cause problems with the electrical connection and also make it difficult to easily disconnect such connections. Indeed, when such problems exist, it can be very difficult to disengage such a connection without breaking or damaging the connectors. A different problem that can arise in this same environment is disconnection which can be caused by air shrinkage inside the socket due to the extreme environmental conditions.

SUMMARY OF THE INVENTION

The present invention is generally directed to an electrical connection for environments with high humidity and low temperatures having a (1) socket with a first connector (typically one or more female connections, such as a hole with an electrical terminal), a recess for receiving a mating part and one or two tabs and a (2) plug with a second connector (typically one or more male connections, such as electrodes), the mating part and a movable hook in which the first and second connectors are protected from moisture when the socket and the plug are electrically connected and the movable hook(s) is (are) engaged with the tab(s) while the hook(s) can be pivoted away from the tab(s) to disconnect the socket and the plug.

In a first, separate group of aspects of the present invention, the plug has a handle connected to its movable hook so that movement of the handle away from the plug causes the hook to disengage from the tab. The handle is securely connected to the plug and is fashioned so as to facilitate pulling the plug out of the socket when its hook is not engaged with the tab in the socket and the handle acts as a lever to help disengage the plug from the socket when the handle is moved from an electrical engagement position to a disconnect position.

In other, separate aspects of the present invention, an insulating material, such as an o-ring, is held in the recess and the plug is connected to a wire harness while one or more tabs is formed either by a slot in a wall of the socket or by extending from a wall of the socket, either of which is distant from the recess (which can be substantially circular) relative to the first connector.

Accordingly, it is a primary object of the present invention to provide an improved plug and socket electrical connection that prevents moisture from coming into contact with electrical terminals while still being held securely in place yet is easy to disengage when it is necessary or desirable to disconnect the plug and socket connection.

This and further objects and advantages will be apparent to those skilled in the art in connection with the drawings and the detailed description of the preferred embodiment set forth below.

DETAILED DESCRIPTION OF THE INVENTION

A preferred embodiment of the present invention provides an electrical connection for a low temperature and high humidity environment that is secure and waterproof.

The present invention will now be discussed in connection with a preferred embodiment shown in FIGS. 1-8.

In the Figures and the following more detailed description, numerals indicate various features of the invention, with like numerals referring to like features throughout both the drawings and the description. Although the Figures are described in greater detail below, the following is a glossary of the elements identified in the Figures.

| | |
|---|---|
| 10 | socket |
| 11 | insulation socket body |
| 12 | insertion holes |
| 13 | circular recess |
| 14 | retaining tab |
| 14A | slot |
| 15 | socket body wall |
| 16 | outer socket body wall |
| 17 | o-ring |
| 20 | plug |
| 21 | plug body |
| 22 | cylindrical part |
| 23 | electrode |
| 24 | handle |
| 25 | hook |
| 26 | propping part |
| 27 | o-ring |
| 50 | cable |
| 60 | cable |
| x | rotary axis |

Figure 1:
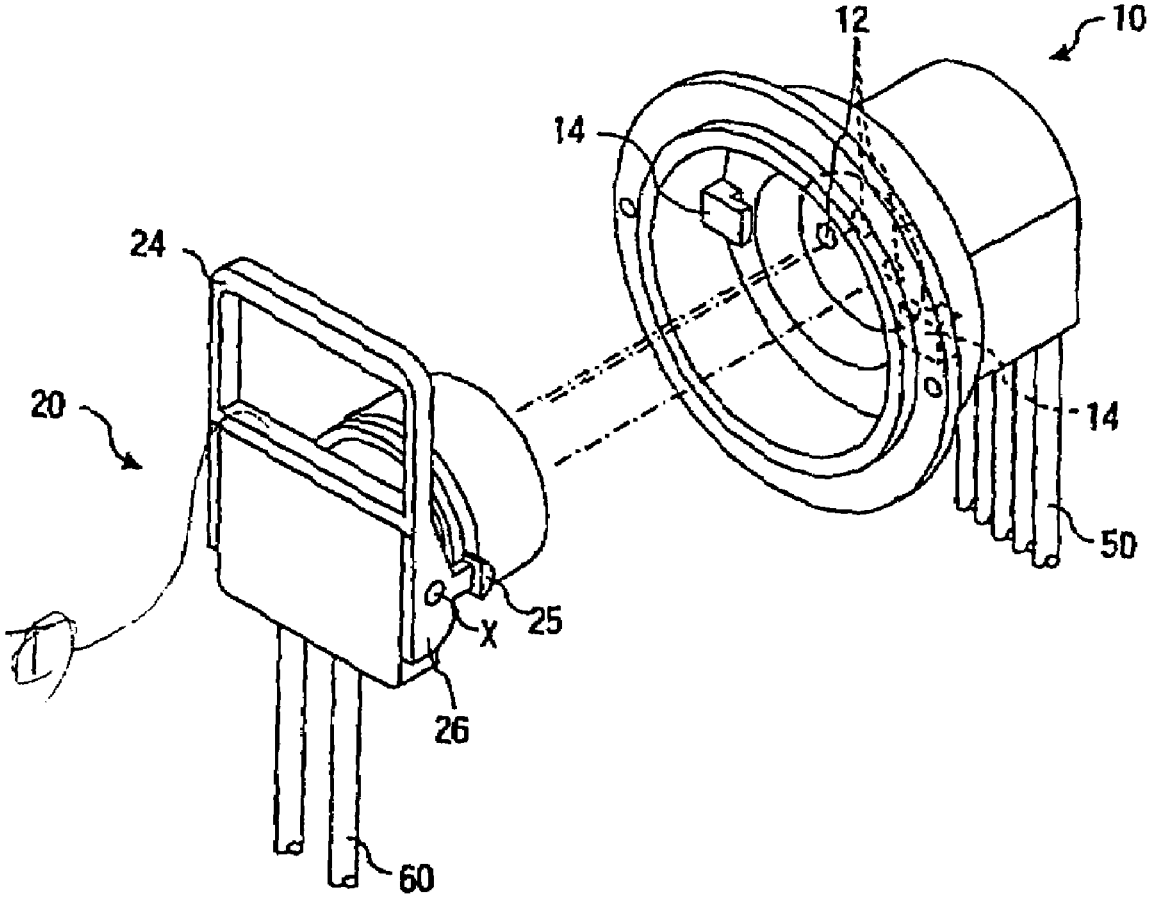
FIG. 1 is a perspective view which shows a socket 10 and a plug 20 lined up for a connection structure, but spaced apart.

As shown in FIG. 1, an electrical connection is made by connecting socket 10 and plug 20. Socket 10 connects to cable 50 and plug 20 connects to cable 60, such as a wire harness.

Figure 2A:
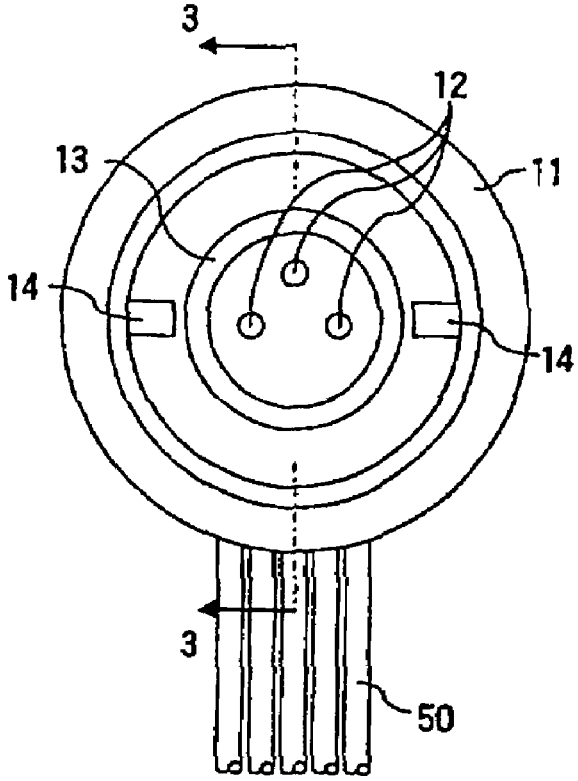
FIG. 2A is a front view of socket 10.
Figure 2B:
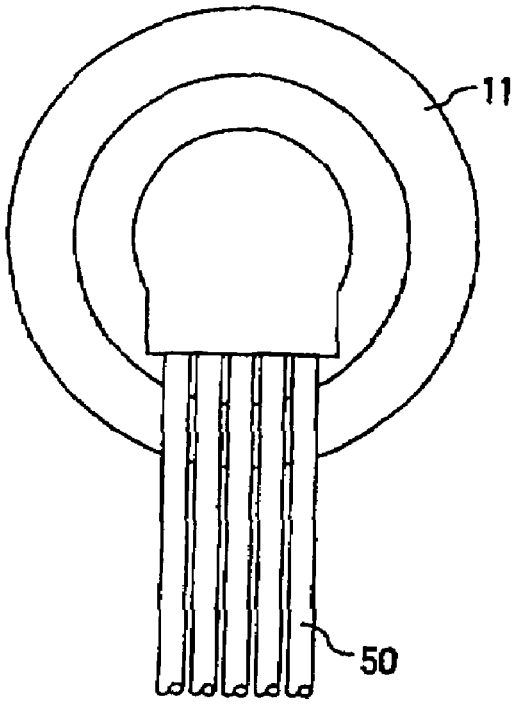
FIG. 2B is a rear view of socket 10.
Figure 3:
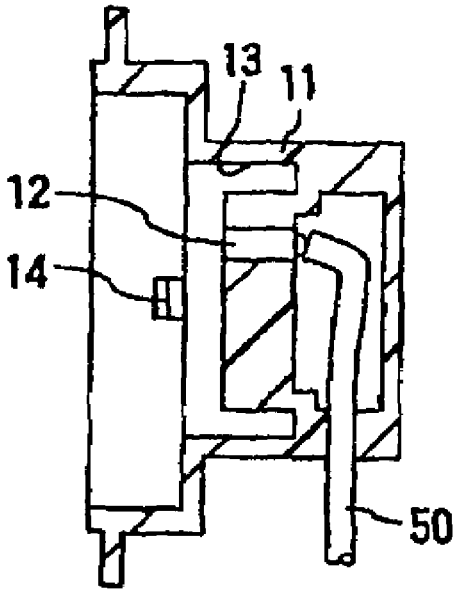
FIG. 3 is a cross section taken along line 3-3 of FIG. 2A.
Figure 7:
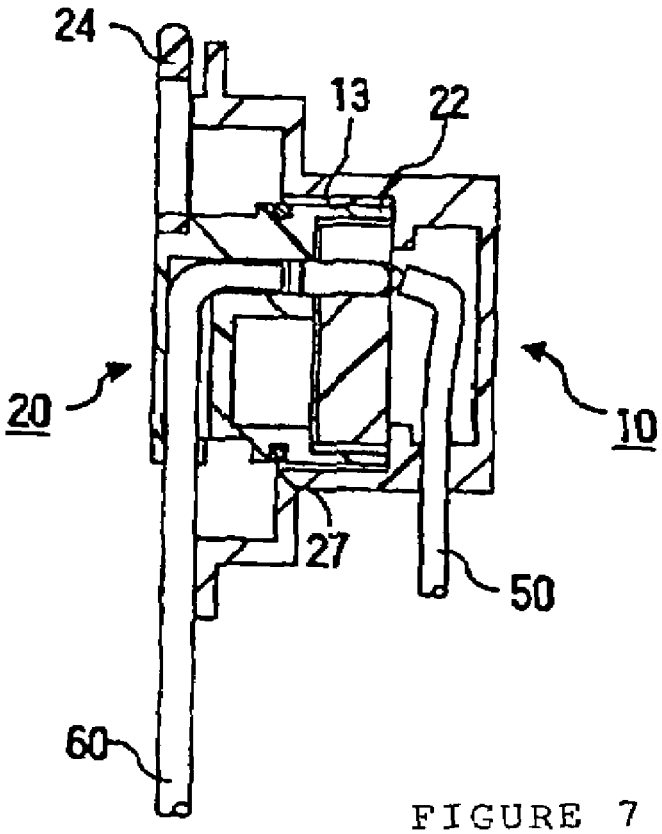
FIG. 7 is a cross section taken along line 7-7 of FIG. 6.

FIGS. 2A, 2B and 3 illustrate socket 10 which contains insulation socket body 11 with a front center circular recess 13 surrounding a base in its front containing three terminal insertion holes 12. Insertion holes 12 have a generally cylindrical shape and are made in the direction of cable 50 that is contained at the backside of socket body 11. Inside each insertion hole 12 there is an electrical terminal (not shown) made of a conductive material (such as metal) that is then electrically connected to cable 50 (also not shown). Insertion holes 12 are aligned so as to receive electrodes 23 (see FIG. 4A) of plug 20. In an especially preferred embodiment, which is illustrated in the Figures, there are three insertion holes 12 and three electrodes 23, but the number of corresponding insertion holes and electrodes can vary without departing from the scope of the present invention.

Recess 13 is shaped so as to receive cylindrical part 22 of plug 20 when plug 20 is connected to socket 10. Waterproof packing, such as an o-ring (not shown in FIGS. 1-8 but shown in FIG. 9) is preferably placed in recess 13 to help waterproof the connection when plug 20 is electrically connected to socket 10; plug 20 is also preferably designed with a built-in lip (not shown) to receive an o-ring to promote a better waterproof seal and thereby keep moisture away from electrodes 23 when plug 20 and socket 10 are connected. Electrodes 23 are made of conductive material (such as metal) that is electrically connected to cable 60.

Retaining tabs 14 in socket 10 are designed to retain flexible hook tabs 25 in plug 20 when plug 20 is inserted into socket 10 and flexible hook tabs 25 snap in place so as to be retained by tabs 14 while establishing an electrical connection. (Either one or both of hook tab 25 and tab 14 must be flexible relative to one another so as to allow insertion of socket 10 into plug 20; the decision as to how such pieces move relative to each other, so that they are allowed to snap in place once plug 20 is inserted into socket 10, is a matter of designer choice.)

Figure 9:
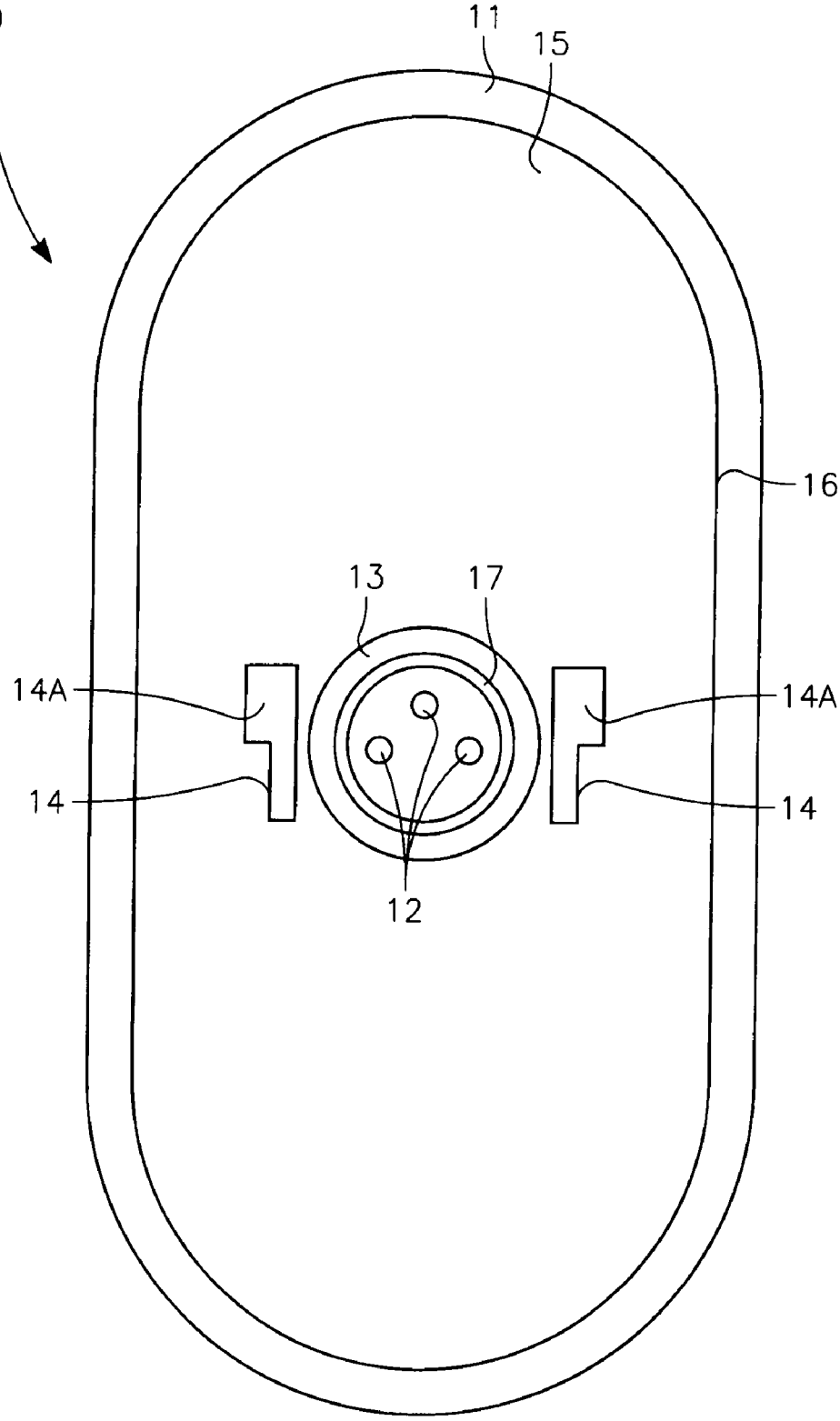
FIG. 9 is an alternative embodiment of a socket 10.

Retaining tabs 14 are shown in FIG. 2A as extending outwardly from a side wall of insulation socket body 11, but they can also be formed in a socket body wall 15 as shown in FIG. 9 which is an alternative and especially preferred embodiment in which insulation socket body 11 is larger and a slot 14A is provided for allowing hooks 25 to be disengaged as will be explained below.

Figure 4A:
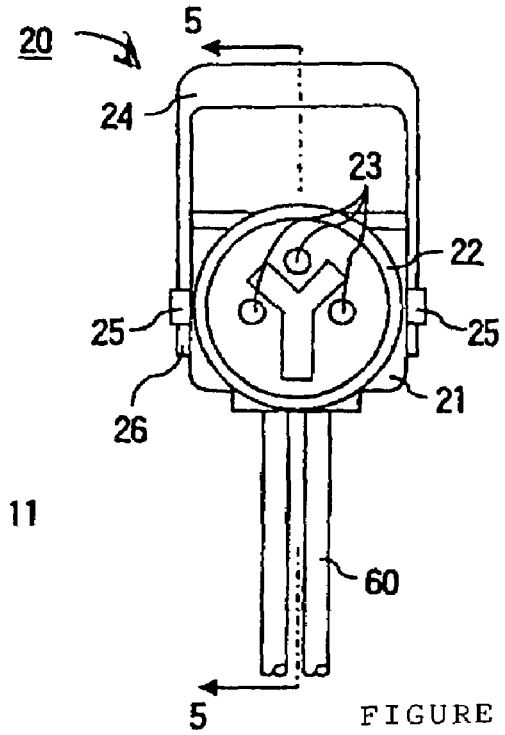
FIG. 4A is a front view of plug 20.
Figure 4C:
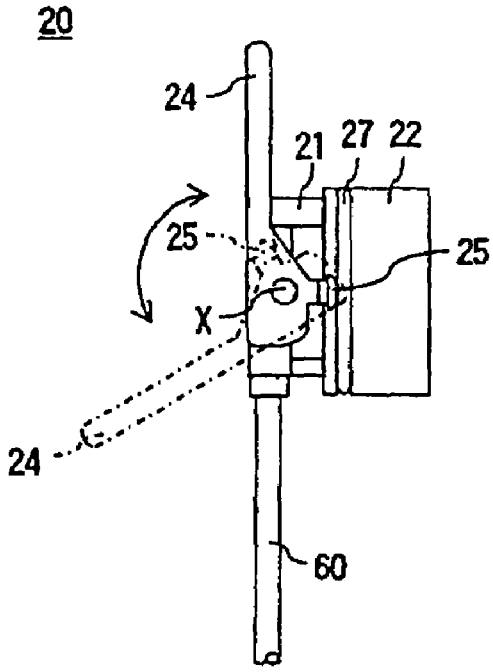
FIG. 4C is a side view of plug 20.
Figure 4B:
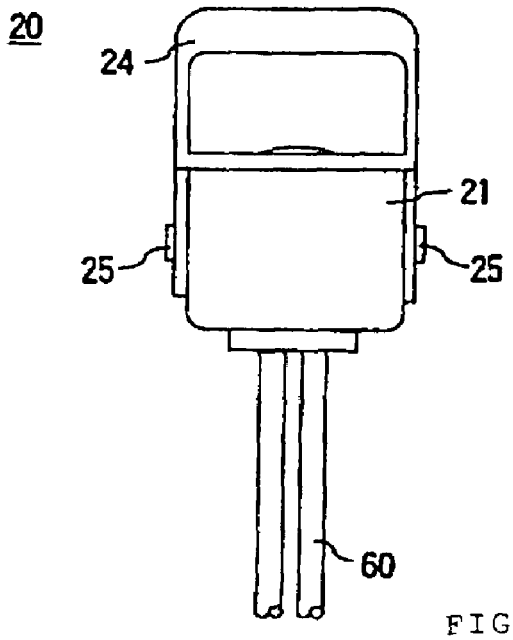
FIG. 4B is a rear view of plug 20.
Figure 5:
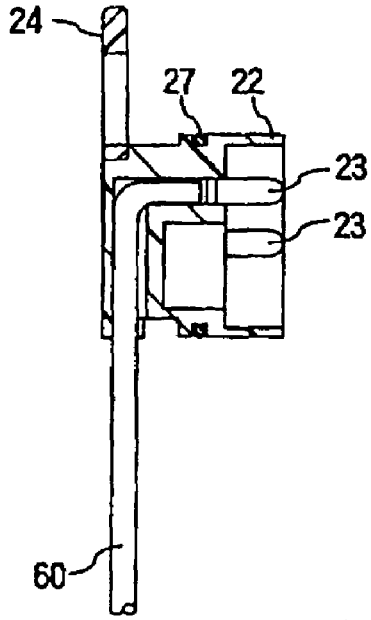
FIG. 5 is a cross section taken along 5-5 of FIG. 4A.
Figure 6:
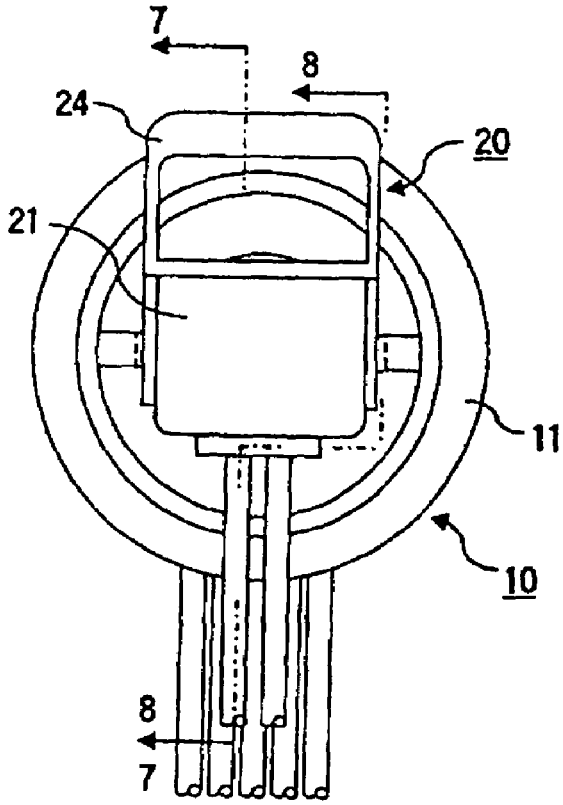
FIG. 6 is a front view of socket 10 and plug 20 connected together.

As shown in FIG. 4C, handle part 24 moves relative to plug body 21 about rotary axis x. Handle part 24 is open to the outside at its center so that a finger can be inserted into the opening to assist in pulling plug 20 out of socket 10. Hooks 25 are connected to handle 24 so that movement of handle 24 also causes movement of hooks 25 and hooks 25 are formed in a hook shape developing to outside at their tops. Waterproof packing, such as o-ring 27, is set about the outside of part 22 to help keep the electrical connections dry when socket 10 and plug 20 are electrically connected.

To connect socket 10 and plug 20, as shown in FIG. 1, handle 24 should be located closest to socket 10 so that hooks 25 are pointed in a direction toward socket 10 and propping part 26 is faced ninety degrees away from the direction of socket 10. As plug 20 is inserted gradually into socket 10, electrodes 23 of plug 20 will be aligned with their corresponding insertion holes 12 of socket 10. As plug 20 moves closer in toward socket 10, hook parts 25 will hit tabs 14 of socket 10 and, as the plug 20 is moved closer to socket 10, either one or both of tabs 14 and hook parts 25 will flex until hook parts 25 snap over tabs 14 and then are retained in place by tabs 14.

Figure 8C:
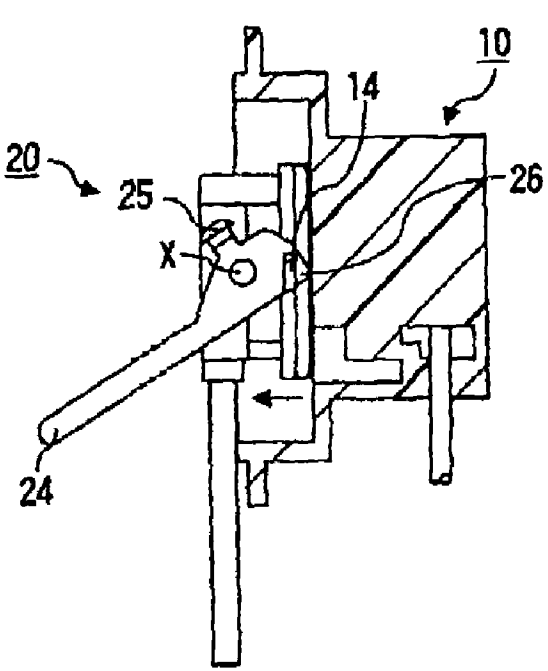
FIGS. 8A, 8B and 8C are cross-section views taken along line 8-8 of FIG. 6 showing movement of the handle.
Figure 8B:
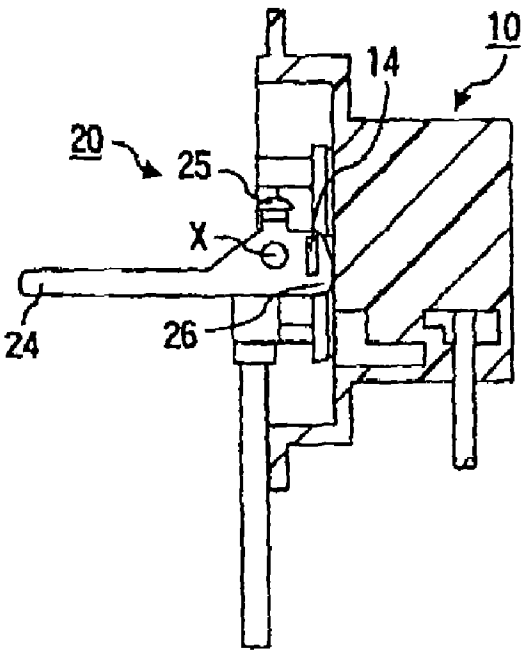
Figure 8A:
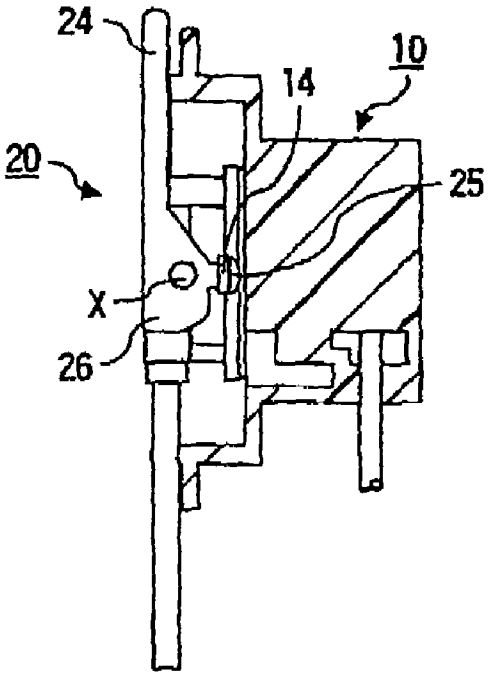

To disconnect socket 10 and plug 20, handle 24 is moved so that it is substantially perpendicular to socket 10 and then it is used to pull plug 20 away from socket 10. In an especially preferred embodiment, handle 24 encounters a stop and is limited in its motion so that it stops when it is substantially perpendicular to socket 10 and pulling on handle at this location is especially preferred. In an alternative embodiment, as shown in FIGS. 8A-C, propping part 26 can be used as a lever to either assist in beginning the movement of plug 20 away from socket 10 or to break any seal that may have been formed. In this embodiment, propping part 26 of handle 24 is longer than hook 25 relative to rotary axis x and propping part 26 is shaped so as to engage socket body 11 and function as a lever to help push plug 20 away from socket 10 when handle 24 is moved outwardly away from its locking position when plug 20 and socket are electrically connected to their disconnect position in which hooks 25 are no longer engaged with, or retained by, tabs 14.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. An electrical connection, comprising:

a socket comprised of a first connector, a recess for receiving a mating part and a tab; and a plug comprised of a second connector, the mating part and a movable hook;

wherein the first connector and second connector matingly engage and are protected from moisture when the socket and the plug are electrically connected in environments with high humidity and low temperatures; and wherein the movable hook engages the tab when the socket and the plug are electrically connected to hold the plug and the socket together and can be pivoted away from the tab to disconnect the socket and the plug;

wherein the tab is formed in a slot in a wall of the socket distant from the recess relative to the first connector; and wherein movement of the handle away from the plug causes the movable hook to disengage from the tab while the socket and plug are electrically connected.

2. The electrical connection of claim 1, wherein the first connector is a female connector and the second connector is a male connector.

3. The electrical connection of claim 1, further comprising a second tab on the socket and a second movable hook on the plug.

4. The electrical connection of claim 1, wherein the plug is further comprised of a rotatable handle connected to the movable hook.

5. The electrical connection of claim 1, wherein the tab extends outwardly from a wall of the socket distant from the recess relative to the first connector.

6. The electrical connection of claim 1, wherein movement of the handle away from the plug causes the handle to act as a lever to help disengage the plug from the socket.

7. The electrical connection of claim 1, wherein the recess is substantially circular.

8. The electrical connection of claim 1, wherein the plug is connected to a wire harness.

9. The electrical connection of claim 1, further comprising an insulating material held in the recess.

10. The electrical connection of claim 9, wherein the insulating material is an o-ring.

* * * * *